US005961337A

United States Patent [19]

Kordes

[11] Patent Number: 5,961,337

[45] Date of Patent: Oct. 5, 1999

[54] UNIVERSAL CHARGING AND DATA COMMUNICATION APPARATUS

[75] Inventor: Kurt A. Kordes, Pleasanton, Calif.

[73] Assignee: Norand Corporation, Cedar Rapids, Iowa

[21] Appl. No.: 08/977,073

[22] Filed: Nov. 24, 1997

Related U.S. Application Data

[60] Provisional application No. 60/031,502, Nov. 27, 1997.

[51] Int. Cl.[6] ..... H01R 13/44

[52] U.S. Cl. ..... 439/141

[58] Field of Search ..... 439/141, 140, 439/63

[56] References Cited

U.S. PATENT DOCUMENTS

| | | | |
|---|---|---|---|
| 4,773,032 | 9/1988 | Uehara et al. | 364/709.04 |
| 5,052,943 | 10/1991 | Davis | 439/357 |
| 5,167,516 | 12/1992 | Tan et al. | 439/141 |
| 5,238,413 | 8/1993 | McCaffrey et al. | 439/79 |
| 5,281,165 | 1/1994 | McCleerey et al. | 439/510 |
| 5,584,713 | 12/1996 | Kato et al. | 439/188 |
| 5,736,782 | 4/1998 | Schairer | 257/679 |
| 5,779,491 | 7/1998 | Nagano et al. | 439/141 |

*Primary Examiner*—Neil Abrams
*Assistant Examiner*—T C Patel
*Attorney, Agent, or Firm*—Suiter & Associates PC

[57] ABSTRACT

A universal recharging and data communication apparatus for electrically and communicatively connecting a hand-held or portable data terminal with a data terminal docking unit comprises mating modules for electrical coupling and data or signal communication. The design of data terminals and docking stations is simplified and the need for a specialized or customized arrangement for the electrical and data communication interface is eliminated by providing the necessary electrical and data links together. In a preferred embodiment, the data communication is provided by a plurality of pins and mating contacts whereby a moveable housing protects the pins when a data terminal is not in the data terminal dock.

18 Claims, 4 Drawing Sheets

UNIVERSAL CHARGING AND DATA COMMUNICATION APPARATUS

RELATED APPLICATIONS

This application claims priority under 35 U.S.C. §119(e) based on U.S. provisional application Ser. No. 60/031,502 (Attorney Docket No. 38291P1), filed Nov. 27, 1997.

TECHNICAL FIELD

The invention relates generally to apparatus for making electrical interconnections and in particular to a universal connector and methods for physically coupling a battery powered data terminal to a recharging and data communication docking apparatus.

BACKGROUND OF THE INVENTION

Portable computers and hand-held data terminals may be powered by internal batteries that can be recharged by connecting the data terminal to some type of docking apparatus. In addition to recharging the hand-held data terminal's batteries, the docking apparatus may also couple the data terminal to other data processing devices, such as a central processing unit, mainframe computer, local area network, peripheral devices such as printers, bar code scanners or other optical readers, fax, modem, radio frequency transceivers, infra red links, optical links, and the like, so that the collected data within the data terminal may be transferred to these devices for transfer, storage, processing, printout, etc.

The industry has generally manufactured a unique docking apparatus for each hand-held data terminal design, with the shape of a docking unit and placement of electrical data connectors within the docking apparatus being dictated by the shape of the computer and placement of the complementary electrical and data contacts thereon. Typically, docking apparatus designs do not share common parts with similar products on the market. This design philosophy has resulted in higher costs to the consumer than would be possible if some sort of modularity or an interchange of common parts could be used. Furthermore, if the user decides to purchase a different hand-held data terminal, he must usually scrap the previously used docking apparatus and purchase entirely new equipment.

Consequently, there is a need for a standardized universal electrical and data communication port which can be used with a variety of portable computer and docking configurations and eliminates the need for a customized configuration of electrical contacts and data communication links for each new data terminal design.

SUMMARY OF THE INVENTION

The present invention provides a universal connector for a portable or hand-held computer and docking apparatus which allows a single part to be employed in a variety of hand-held terminal designs or configurations. The preset invention simplifies the design and manufacture of portable data terminals by eliminating the need for a separate design and/or building customized parts for electrical and data contacts in new data terminal designs. Thus, the present invention represents an improvement in the art pertaining to the interconnection of hand-held or other portable data collection or data entry terminal devices with an apparatus for recharging and data communication. The apparatus according to the present invention also requires a very small amount of space and is advantageous for use in portable and hand-held data terminals where small size is desirable.

The present invention provides charging and data communication connections in an apparatus comprising mating connectors. The mating connectors for the docking unit and the data terminal are located on two complementary modules, one for mounting in a docking unit, and one for mounting within a data terminal. The modules comprise mating recharging contacts, mating multiple pin data communication contacts, and a mating coaxial connection. An infra red (IR) port can also be integrated into the data terminal module.

The dock employing the universal connector according to the present invention can be configured in a number of ways to accommodate either a single hand-held data terminal, multiple data terminals of the same type, or multiple data terminals of different types, etc. The docking apparatus can be of a stationary type, i.e., mounted on a table, wall, or other stationary fixture, or may be a mobile dock for use in a vehicle such as a delivery truck, forklift, etc., allowing charging via a vehicle's electrical system and/or data communication with a LAN or WAN, peripheral devices such as fax, modem, optical readers, printers, and the like.

It is, therefore, an object of the invention to provide a universal recharging and data communication link comprising a standardized module adaptable for use in a variety of data terminal configurations and which can be incorporated into a variety of terminal and dock designs using the same basic parts, thereby eliminating the need for a specialized or custom design, configuration and placement in data terminal and dock designs.

Another object of the present invention is to provide a hand-held data terminal and/or docking apparatus employing the universal recharging and data communication link according to the present invention.

BRIEF DESCRIPTION OF THE DRAWINGS

The detailed description of the invention may be best understood when read in reference to the accompanying drawings wherein.

DETAILED DESCRIPTION OF A PREFERRED EMBODIMENT

Figure 1:
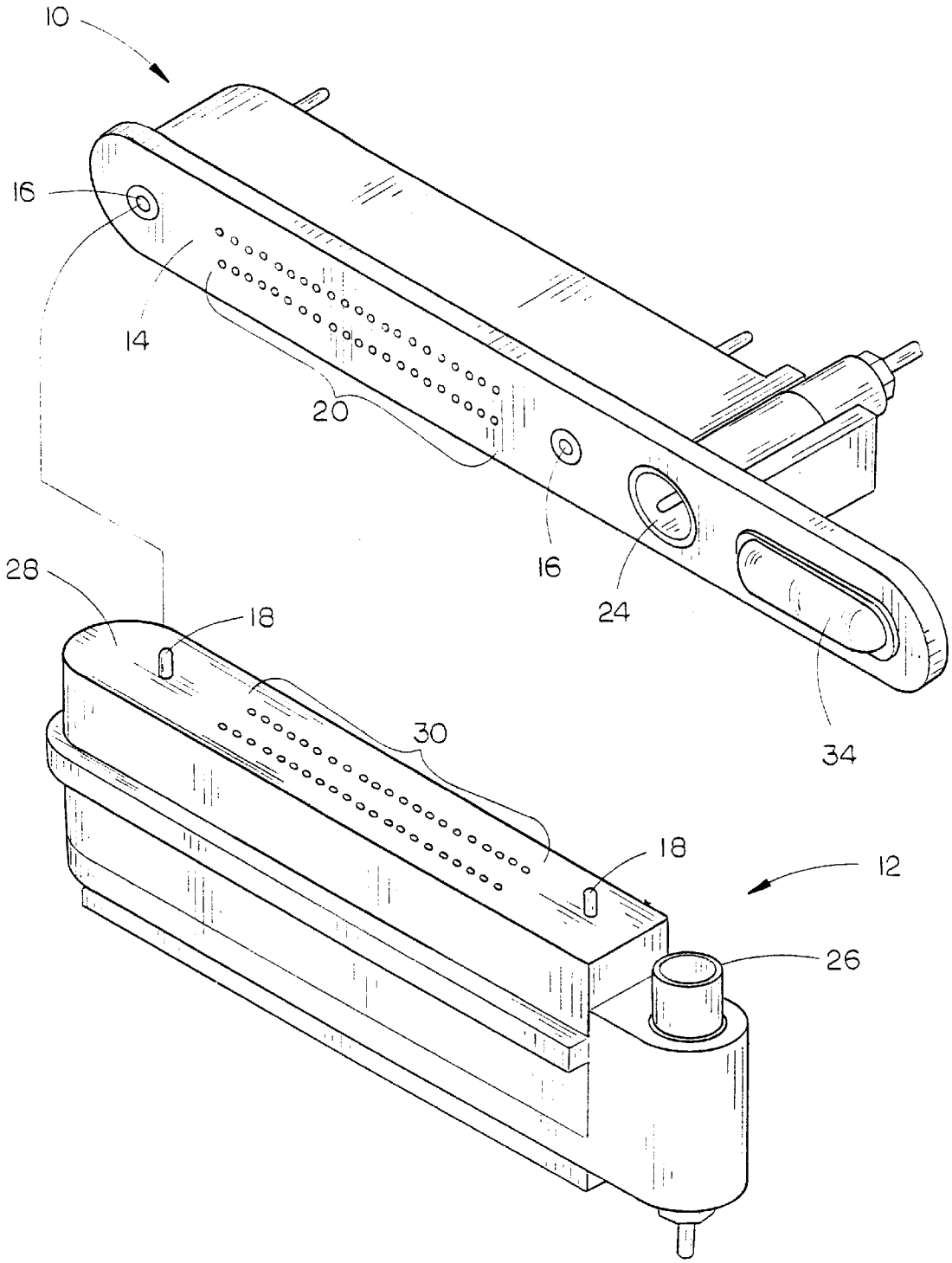
FIG. 1 is a perspective view of one embodiment of the invention showing the complimentary terminal and dock modules unengaged.
Figure 2:
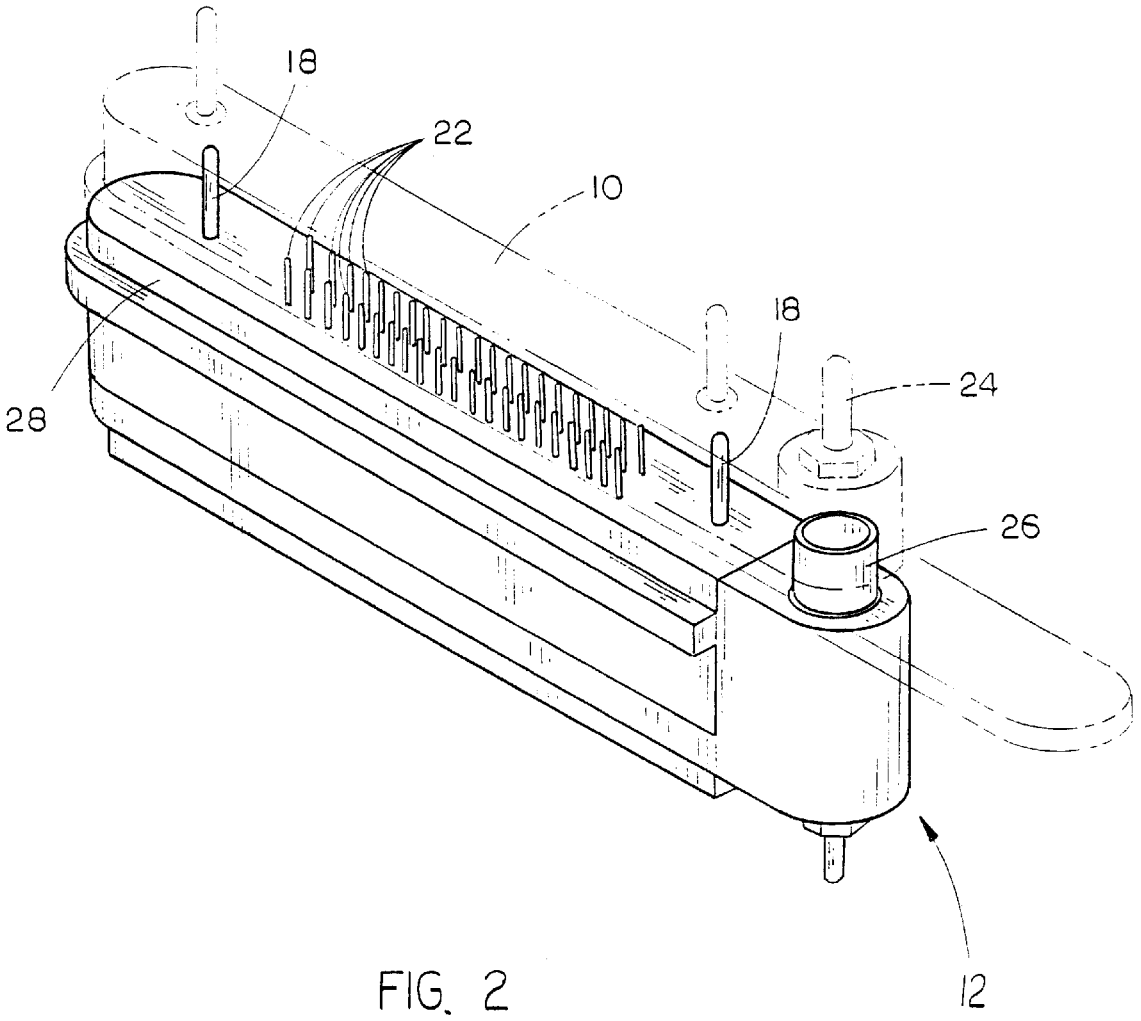
FIG. 2 is a perspective view of one embodiment of the present invention showing the terminal dock module in engaged position.

FIG. 1 and 2 depict one embodiment of the apparatus according to the present invention in perspective view comprising complimentary mating modules 10 and 12. In this preferred embodiment shown, module 10 is preferably located within a portable or hand-held data terminal such that outer surface 14 of module 10 is generally flush with an outer surface of the data terminal's housing, and module 12 is mounted within a terminal docking unit.

Module 10 in FIG. 1 comprises female electrical charging contacts 16 which mate with male electrical charging pins 18 on module 12. Module 10, as depicted in FIG. 1, also comprises female signal or data contacts 20 which mate with male signal or data pins 22. Although not limited to any particular number or configuration of pins, contacts 20 and 22 may advantageously employ a standard configuration employed with parallel, serial, SCSI, etc. connectors, for example, HD-15, HDI-30, DB-25, DB-50, or other connectors, such as 40 pin, 20 pin, 36 or 37 pin, etc. Also, any other custom or nonstandard connectors having any number of pins may be employed.

Modules 10 and 12 in FIG. 1 further comprise mating coaxial connectors, preferably of the push-on type. As depicted, module 10 comprises male coaxial connector 24 which mates with female coaxial connector 26 on module 12. It is understood, however, that the gender of the coaxial connectors 24 and 26 may be reversed.

Module 12 additionally comprises a depressible member 28 comprising a series of holes 30 that house male pins 22 (FIG. 2) such that when no terminal is docked, depressible member 28 is urged outwardly along data pins 22 and charging posts 18 such that data pins 22 are housed within holes 30 of depressible member 28. This provides protection against bending, breaking, and corrosion of the data or signal pins 22. The range of motion of depressible member 28 is such that when no data terminal is mounted within a dock containing module 12, depressible member will be urged outwardly such that the signal pins 22 will be totally or partially engulfed within holes 30.

Charging posts 18 are preferably longer than pins 22 such that the ends of posts 18 protrude from depressible member 28 even when pins 22 are completely engulfed within holes 30. For this reason, posts 18 are likewise larger in diameter and otherwise more ruggedly constructed. Although posts 18 are primarily for providing current for charging a data terminal's battery, when posts 18 are allowed to protrude, they may then advantageously serve a secondary function as guides for proper alignment of the terminal within the dock. However, since a docking unit itself will generally have alignment guides such as grooves, guide rollers, etc., to assure proper alignment, it is not necessary that the charging posts 18 extend beyond member 28, and the posts 18 according to the present invention may likewise be of such a length as to be substantially level with or be beneath the level of the outer surface of member 28 when member 28 is in its undepressed state.

It preferable that when depressible member 28 is in the outermost, undepressed position, as shown in FIG. 1, the ends pins 22 will be beneath the surface or substantially aligned with the surface of depressible member 28, although it is within the scope of the invention that a portion of each pin 30 be permitted to remain above the outer surface of depressible member 28 when member 28 is in its undepressed state. When a portion of pins 30 is permitted to protrude from member 28 in its undepressed state, such protruding portions may additionally serve the secondary function as alignment guides for docking the data terminal.

FIG. 2 depicts the embodiment shown in FIG. 1 wherein depressible member 28 is in its depressed state, and with module 10 shown in phantom lines.

Referring again to FIG. 1, the coaxial connectors 24 and 26 are preferably used for data terminals having a wireless RF link. For example, a data terminal may contain a RF transceiver for communication with a mainframe computer, local area network (LAN), wide area network (WAN), etc. For example, a data terminal may be used to collect data such as sales, delivery, inventory, accounting, or other information during a worker's entire route or shift, and then be docked in a data terminal dock for communicating the accumulated data to the computer, network, etc. In other instances, such data may be transmitted in real time or near real time.

In such instances, it is advantageous that the dock be connected to a higher gain antenna than the standard whip antenna generally employed with a portable data terminal. When the terminal is docked, the terminal's transceiver may then employ the remote antenna for establishing a superior RF link. Use of the remote antenna minimizes link loss due to low gain antennae, minimizes link loss due to vehicle shielding, and increases radiated sensitivity by reducing terminal noise at antenna input. The data terminal preferably comprises a switching means for diverting the terminal's transceiver antenna port from the standard whip antenna to the remote antenna, and may be mechanical or manual, or may be controlled by the data terminal's software or via switching circuitry within the data terminal.

Although the embodiment shown in FIGS. 1 and 2 show the charging, data, and coaxial connectors in a particular physical arrangement and with a specific arrangement with respect to gender, it is understood that the embodiment depicted is simply one preferred embodiment, and other modifications are also within the scope of the present invention. For example, module 10 may be employed on the dock and module 12 may be employed on the data terminal. Also, the gender of one or more of the connectors shown may be reversed.

Figure 3:
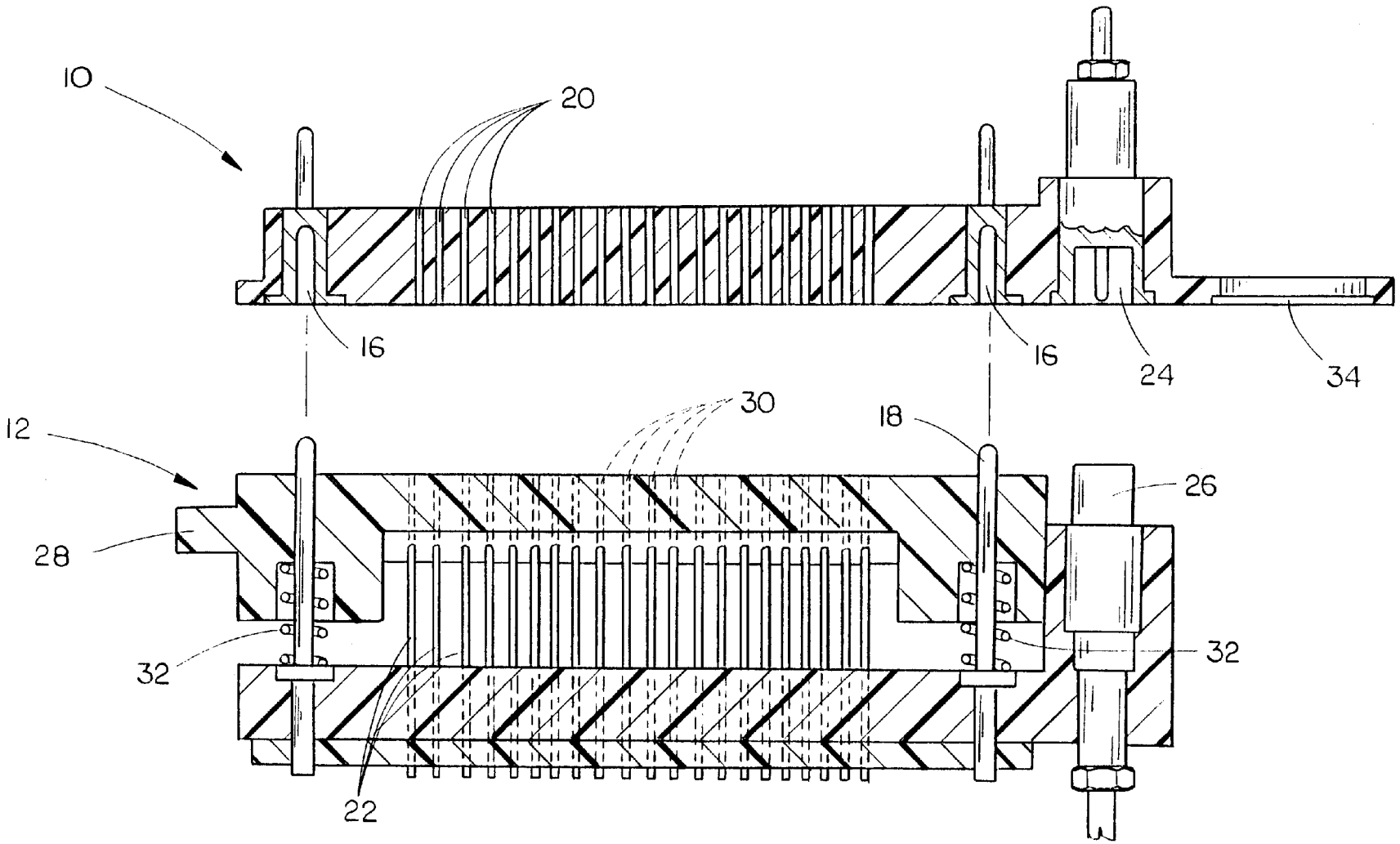
FIGS. 3 and 4 are sectional views of the embodiment of the invention shown in FIGS. 1 and 2.
Figure 4:
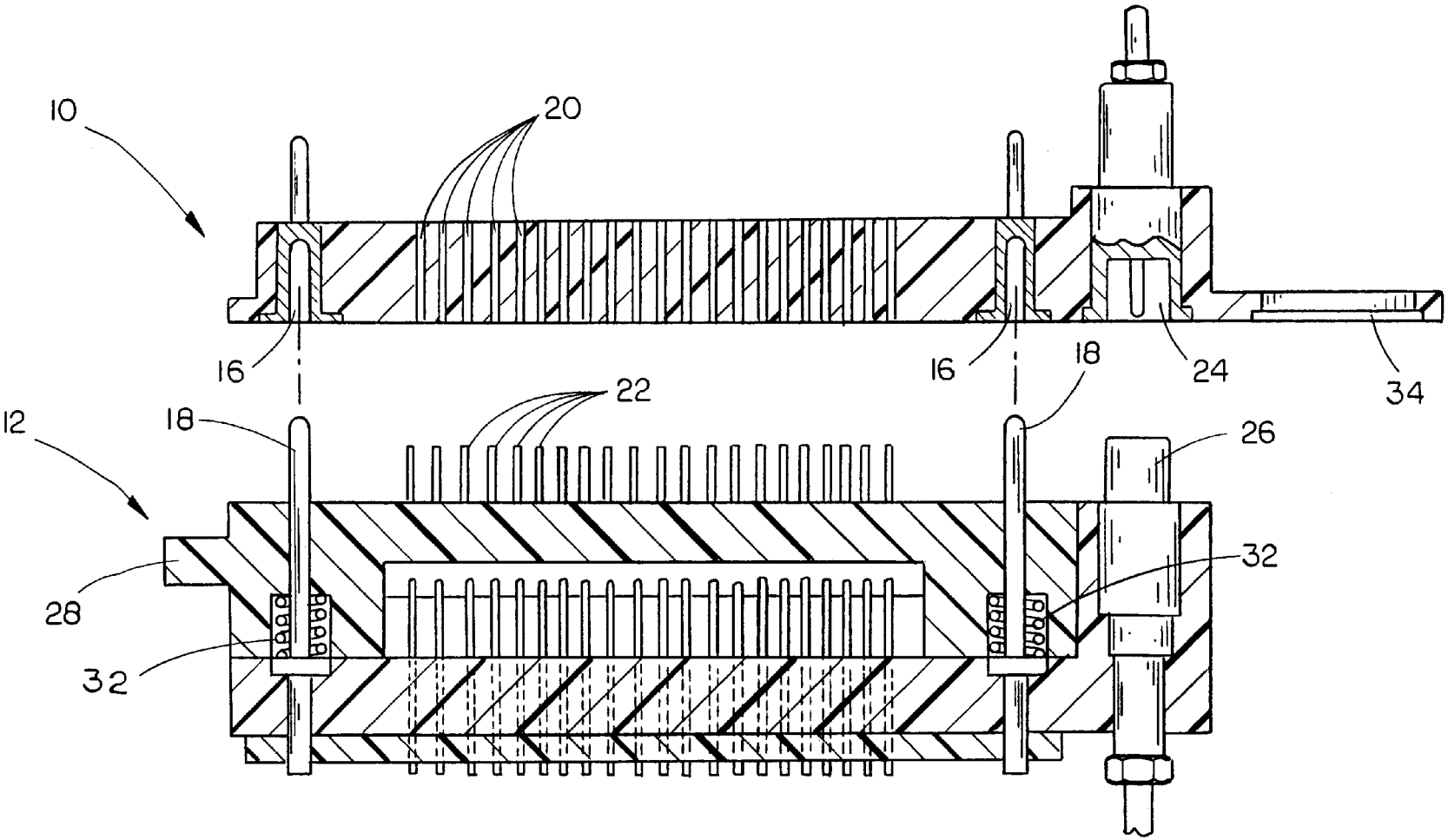

FIGS. 3 and 4 show a side cross-sectional view of the embodiment shown in FIGS. 1 and 2 wherein the operation of depressible member 28 may be more clearly seen. When a data terminal comprising module 10 is mounted within a docking unit comprising module 12, wherein charging posts 18 are aligned with female charging contacts 16, depressible member 28 is urged downward against the urging of captured springs 32 whereby coaxial connectors 24 and 26 are connected, and whereby data signal pins 22 and contacts 20 are communicatively coupled. FIG. 3 shows member 28 in its undocked position and FIG. 4 shows member 28 in its depressed docked position. Member 28 may be retained in its locked position via a locking device (not shown) which may be located on the dock, the data terminal housing, or may be a part of modules 10 and 12. Alternatively, the weight of the data terminal may be employed for retaining member 28 in its depressed position. Also, the docking unit may be provided with a means for retaining a data terminal, such as a resilient protrusion which engages a complimentary depression on the data terminal's housing, or other means for physically retaining the terminal in the dock, and as such, may also function as the means for retaining member 28 in the depressed position.

In FIGS. 1–4, module 10 is also depicted with IR port 34. In alternative embodiments, not shown, the IR port may be omitted, or one or more alternative or additional wireless links may be employed, such as optical link, ultrasound link, and the like, may be employed in place of or in addition to the IR link depicted.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents.

I claim:

1. A universal connector for a portable data terminal and a data terminal docking apparatus, comprising mating first and second modules:

said first module comprising a first set of battery charging contacts, a first set of electrical data contacts, and a first RF antenna connector; and said second module comprising:

a second set of electrical data contacts comprising a plurality of conductive pins mateable with said first set of electrical data contacts;

a second set of battery charging contacts mateable with said first set of battery charging contacts;

a second RF antenna connector mateable with said first RF antenna connector; and a moveable housing comprising a plurality of holes retaining said conductive pins and said second set of battery charging contacts, said housing moveable between a first position when said first and second modules are disengaged and a second position when said first and second module are engaged, wherein said conductive pins do not extend beyond said housing when said housing is in said first position and wherein a portion of said conductive pins extend beyond an outer when said housing is in said second position, and wherein a portion of said second set of battery charging contacts protrude beyond said moveable housing when said housing is in said first position, said protruding potion of said second set of battery charging contacts disposed so as to automatically position said first and second module in proper alignment for operative engagement when the protruding portion of said second set of battery contacts are aligned in facing relation with said first set of battery charging contacts.

2. A universal connector according to claim 1, wherein the first module further comprises an IR port.

3. A universal connector according to claim 1, wherein said first and second RF antenna connectors comprise mating coaxial cable connectors.

4. A universal connector according to claim 3, wherein said first RF connector comprises a male coaxial cable connector and said second RF antenna connector comprises a female coaxial cable connector.

5. A universal connector according to claim 3, wherein said first RF connector comprises a female coaxial cable connector and said second RF antenna connector comprises a male coaxial cable connector.

6. A universal connector according to claim 1, wherein said first set of charging contacts comprises conductive holes and said second set of charging contacts comprises conductive posts which engage said holes.

7. A universal connector for a portable data terminal and a data terminal docking apparatus, comprising mating first and second modules:

said first module comprising a first set of battery charging contacts, a first set of electrical data contacts, and a first RF antenna connector; and said second module comprising:

a second set of electrical data contacts comprising a plurality of conductive pins, mateable with said first set of electrical data contacts;

a second set of battery charging contacts mateable with said first set of battery charging contacts;

a second RF antenna connector mateable with said first RF antenna connector; and a moveable housing comprising a plurality of holes retaining said conductive pins and said second set of battery charging contacts, said housing moveable between a first position when said first and second modules are disengaged and a second position when said first and second module are engaged, wherein said moveable housing engages one or more springs urging said moveable housing toward said first position wherein said conductive pins do not extend beyond said housing when said housing is in said first position and wherein a portion of said conductive pins extend beyond an outer when said housing is in said second position, and wherein a portion of said second set of battery charging contacts protrude beyond said moveable housing when said housing is in said first position, said protruding potion of said second set of battery charging contacts disposed so as to automatically position said first and second module in proper alignment for operative engagement when the protruding portion of said second set of battery contacts are aligned in facing relation with said first set of battery charging contacts.

8. A universal connector according to claim 7, wherein the first module further comprises an IR port.

9. A universal connector according to claim 7, wherein said first and second RF antenna connectors comprise mating coaxial cable connectors.

10. A universal connector according to claim 9, wherein said first RF connector comprises a male coaxial cable connector and said second RF antenna connector comprises a female coaxial cable connector.

11. A universal connector according to claim 9, wherein said first RF connector comprises a female coaxial cable connector and said second RF antenna connector comprises a male coaxial cable connector.

12. A universal connector according to claim 7, wherein said first set of charging contacts comprises conductive holes and said second set of charging contacts comprises conductive posts which engage said holes.

13. A data capture system, comprising a portable data terminal and a docking apparatus, said portable data terminal and said docking apparatus operable to be electrically and communicatively coupled via a universal connector comprising mating first and second modules, said first module operatively positioned on one of said portable data terminal and said docking apparatus and said second module operatively positioned on the other of said portable data terminal and said docking apparatus, said universal connector comprising:

said first module comprising a first set of battery charging contacts, a first set of electrical data contacts, and a first RF antenna connector; and said second module comprising:

a second set of electrical data contacts comprising a plurality of conductive pins mateable with said first set of electrical data contacts;

a second set of battery charging contacts mateable with said first set of battery charging contacts;

a second RF antenna connector mateable with said first RF antenna connector; and a moveable housing comprising a plurality of holes retaining said conductive pins and said second set of battery charging contacts, said housing moveable between a first position when said first and second modules are disengaged and a second position when said first and second module are engaged, wherein said conductive pins do not extend beyond said housing when said housing is in said first position and wherein a portion of said conductive pins extend beyond an outer when said housing is in said second position, and wherein a portion of said second set of battery charging contacts protrude beyond said moveable housing when said housing is in said first position, said protruding potion of said second set of battery charging contacts disposed so as to automatically position said first and second module in proper alignment for operative engagement when the protruding portion of said second set of battery contacts are aligned in facing relation with said first set of battery charging contacts.

14. A data capture system according to claim 13, wherein the first module further comprises an IR port.

15. A data capture system according to claim 13, wherein said first and second RF antenna connectors comprise mating coaxial cable connectors.

16. A data capture system according to claim 15, wherein said first RF connector comprises a male coaxial cable connector and said second RF antenna connector comprises a female coaxial cable connector.

17. A data capture system according to claim 15, wherein said first RF connector comprises a female coaxial cable connector and said second RF antenna connector comprises a male coaxial cable connector.

18. A data capture system according to claim 13, wherein said first set of charging contacts comprises conductive holes and said second set of charging contacts comprises conductive posts which engage said holes.

* * * * *